US007755036B2

(12) United States Patent
Satoh

(10) Patent No.: US 7,755,036 B2
(45) Date of Patent: Jul. 13, 2010

(54) INSTRUMENT AND METHOD FOR TANDEM TIME-OF-FLIGHT MASS SPECTROMETRY

(75) Inventor: Takaya Satoh, Tokyo (JP)

(73) Assignee: Jeol Ltd., Tokyo (JP)

( * ) Notice: Subject to any disclaimer, the term of this patent is extended or adjusted under 35 U.S.C. 154(b) by 416 days.

(21) Appl. No.: 11/972,365

(22) Filed: Jan. 10, 2008

(65) Prior Publication Data

US 2009/0026365 A1 Jan. 29, 2009

(30) Foreign Application Priority Data

Jan. 10, 2007 (JP) ..... 2007-001997

(51) Int. Cl.
*H01J 49/00* (2006.01)

(52) U.S. Cl. ..... 250/287; 250/281; 250/282; 250/283; 250/286; 250/288; 250/290; 250/291; 250/292; 250/293; 250/294; 250/295; 250/296; 250/297; 250/298; 250/299; 250/300

(58) Field of Classification Search ..... 250/281, 250/282, 284, 286, 287, 288, 289, 290, 291, 250/292, 293, 294, 295, 296, 297, 298, 299, 250/300

See application file for complete search history.

(56) References Cited

U.S. PATENT DOCUMENTS 4,625,112 A 11/1986 Yoshida
6,300,627 B1 10/2001 Koster et al.
6,441,369 B1 8/2002 Vestal et al.
2007/0029473 A1 * 2/2007 Verentchikov ..... 250/281

FOREIGN PATENT DOCUMENTS

| | | |
|---|---|---|
| GB | 2 080 021 A | 1/1982 |
| JP | 2000-243345 | 9/2000 |
| JP | 2003-086129 | 3/2003 |
| JP | 2005-302728 | 10/2005 |
| JP | 2006-012782 | 1/2006 |
| JP | 2006-196216 | 7/2006 |
| WO | WO 2005/001878 A2 | 1/2005 |

OTHER PUBLICATIONS

Michisato Toyoda et al., "Multi-Turn Time-of-Flight Mass Spectrometers With Electrostatic Sectors," J. Mass. Spectrom. 2003; 38, pp. 1125-1142.

* cited by examiner

*Primary Examiner*—Jack I Berman
*Assistant Examiner*—Hanway Chang
(74) *Attorney, Agent, or Firm*—The Webb Law Firm

(57) ABSTRACT

A novel instrument and method for TOF/TOF mass spectrometry is offered. A spiral trajectory time-of-flight mass spectrometer satisfies the spatial focusing conditions for the direction of flight and a direction orthogonal to the direction of flight whenever ions make a turn in the spiral trajectory. An ion gate for selecting precursor ions is placed in the spiral trajectory of the spiral trajectory time-of-flight mass spectrometer. Electric sectors are placed downstream of the ion gate.

19 Claims, 14 Drawing Sheets

LINEAR TOFMS

ARRIVING TO DETECTOR FROM A
SMALL ION OF THE MASS

TOFMS

MALDI METHOD AND DELAYED EXTRACTION METHOD

TOF/TOF INSTRUMENT

PRECURSOR ION SELECTIVITY OF PRIOR ART

PRECURSOR ION SELECTIVITY OF EMBODIMENT 1

ISOTOPE AND MONOISOTOPIC PEAKS OF ANGIOTENSIN I

EMBODIMENT 3 ms/ms MEASUREMENT SELECTING PLURAL PRECURSOR IONS

A METHOD TO IMPRESS THE VOLTAGE
TO REFLECTOR OF EMBODIMENT 6

INSTRUMENT AND METHOD FOR TANDEM TIME-OF-FLIGHT MASS SPECTROMETRY

BACKGROUND OF THE INVENTION

1. Field of the Invention

The present invention relates to instrument and method for tandem time-of-flight mass spectrometry used for quantitative analysis and simultaneous qualitative analysis of trace amounts of compounds and used for structural analysis of sample ions.

2. Description of Related Art

[Mass Spectrometers]

A mass spectrometer ionizes a sample in an ion source, separates the ions according to each value of m/z (mass-to-charge ratio) by the mass analyzer, and detects the separated ions by a detector. The result is shown in the form of a mass spectrum in which m/z value is plotted on the horizontal axis, while the relative amount is on the vertical axis. The m/z values and relative intensities of compounds contained in the sample are obtained. Qualitative and quantitative information of the sample can be derived. Various methods are available for ionization, mass separation, and ion detection. The present invention is especially closely associated with mass separation. Depending on different principles of mass separation, mass spectrometers are classified as a quadrupole mass spectrometer (QMS), an ion-trap mass spectrometer (ITMS), a magnetic sector mass spectrometer, time-of-flight mass spectrometer (TOFMS), and a Fourier transform ion cyclotron resonance mass spectrometer (FTICRMS).

[MS/MS Measurement and MS/MS Instrument]

In a mass spectrometer, ions created in the ion source are separated according to each value of m/z in the mass analyzer, and the separated ions are detected. The result is represented in the form of a mass spectrum in which m/z values of the ions and their relative amounts are graphically plotted. This measurement is hereinafter referred to as MS measurement in contrast with MS/MS measurement described later. In the MS/MS measurement, certain ions created in the ion source are selected by the first stage of mass spectrometer (abbreviated as MS1). The selected ions are referred to as precursor ions and are permitted to spontaneously fragment or are forced to be fragmented. The resulting product ions are mass-analyzed in the later-stage MS spectrometer (hereinafter abbreviated as MS2). An instrument enabling this MS/MS measurement is referred to as an MS/MS instrument (FIG. 1).

In MS/MS measurement, the m/z values of precursor ions, the m/z values of product ions produced in plural fragmentation pathways, and information about their relative intensities are obtained. Therefore, structural information about the precursor ions can be derived (FIG. 2). Variations of the aforementioned combination of two mass spectrometers are present as MS/MS instruments capable of MS/MS measurements. Furthermore, there are many fragmentation methods including collision induced dissociation (CID) using collision with gas, photodissociation, and electron capture or transfer. The instrument associated with the present invention is an MS/MS instrument including two TOF-MS instruments connected in tandem. A CID-based fragmentation means is interposed between the two TOF-MS instruments. Generally, this system is referred to as TOF/TOF.

Fragmentation information derived by an MS/MS instrument using a CID method is different depending on different collision energy, i.e., on different kinetic energy of ions entering the collision cell. In the case of the presently utilized MS/MS instruments, the energies are classified into low-energy CID of the order of tens of eV and high-energy CID of several kV to tens of kV. The difference is affected by the instrumental configuration. This is summarized in Table 1.

TABLE 1

| MS1 | MS2 | collision energy |
|---|---|---|
| QMS | QMS | low |
| QMS | TOFMS | low |
| TOFMS | TOFMS | high |
| magnetic sector MS | magnetic sector MS | high |
| magnetic sector MS | QMS | low |
| ion-trap MS | ion-trap MS | low |
| ion-trap MS | TOFMS | low |
| FTICR-MS | FTICR-MS | low |

An advantage of high-energy CID is that side-chain information may be obtained in fragmentation of peptides in which tens of amino acids are chained together. It is possible to discriminate between leucine and isoleucine having the same molecular weight.

[Time-of-flight Mass Spectrometer (TOFMS)]

TOFMS is a mass spectrometer for finding mass-to-charge ratios of ions by giving a constant amount of energy to the ions so that the ions are accelerated and made to travel and finding the mass-to-charge ratios from times in which the ions arrive at the detector. In TOFMS, ions are accelerated with a constant pulsed voltage of $V_a$. At this time, from the law of conservation of energy, the velocity of each ion is given by $$\frac{mv^2}{2} = qeV_a \tag{1}$$

$$v = \sqrt{\frac{2qev}{m}} \tag{2}$$

where m is the mass of the ion, q is the electric charge of the ion, and e is the elementary charge.

The ion reaches the detector rearwardly placed at a certain distance L in a flight time T.

$$T = \frac{L}{v} = L\sqrt{\frac{m}{2qeV}} \tag{3}$$

Eq. (3) indicates that the flight time T differs depending on the mass mn of the ion. An instrument for separating masses by utilizing this principle is a TOFMS. One example of a linear TOFMS is shown in. FIG. 3. Furthermore, reflectron TOF-MS instruments in which improvement of energy focusing and extension of flight distance are enabled by placing a reflectron field between an ion source and a detector have enjoyed wide acceptance. One example of reflectron TOFMS is shown in FIG. 4.

[Spiral Trajectory TOFMS]

The mass resolving power of a TOFMS instrument is defined by $$\text{mass resolving power} = \frac{T}{2\Delta T} \tag{4}$$

where T is the total flight time and ΔT is a peak width. That is, if the total flight time T can be prolonged while maintaining constant the peak width ΔT, the mass resolution can be improved. However, in the prior art linear TOFMS and reflectron TOFMS, prolongation of the total flight time T, i.e., increase of the total flight distance, will immediately result in an increase in size of the instrument.

A multi-turn time-of-flight mass spectrometer is an instrument developed to realize high-mass resolving power while avoiding bulkiness of the instrument (see, M. Toyoda, D. Okumura, M. Ishihara and I. Katakuse, J. Mass Spectrom., 2003, 38, pp. 1125-1142). This instrument uses four toroidal electric fields in each of which Matsuda plates are combined with a cylindrical electric field. Ions are made to make multiple turns in an 8-shaped orbit. Consequently, the total flight time T can be prolonged. This instrument succeeds in conserving spatial spread and time spread at the detection surface up to the first-order term.

However, the TOFMS in which ions are made to make multiple turns in a closed orbit suffers from an overtaking problem. That is, since the ions make multiple turns in a closed orbit, small m/z ions with large velocities overtake large m/z ions with smaller velocities. Therefore, the fundamental concept of TOFMS that lighter ions arrive at the detection surface earlier is invalidated.

A spiral ion trajectory TOFMS has been devised to solve this problem. The spiral trajectory TOFMS is characterized in that the starting and ending points of the closed trajectory are shifted with respect to the plane of the closed trajectory in an orthogonal direction. This is achieved by a method of entering ions obliquely from the beginning (JP-A-2000-243345), by a method of shifting the starting and ending points of the closed trajectory in an orthogonal direction using a deflector (JP-A-2003-86129), or by a method using laminated toroidal electric fields (JP-A-2006-12782).

A further TOFMS based on a similar concept has also been devised (WO/2005/001878). In this instrument, the trajectory of a multiple reflection TOFMS (U.K. Patent No. 2080021) in which overtaking occurs is zigzagged.

[MALDI Technique and Delayed Extraction]

A MALDI technique is a method consisting of preparing a matrix (such as liquid, crystalline compound, metal powder, or the like) having an absorption band in the wavelength of the used laser light, mixing and dissolving a sample in the matrix, solidifying it, and irradiating the matrix with the laser light to vaporize or ionize the sample. In a laser-induced ionization method typified by the MALDI technique, the initial energies produced during ion creation are distributed over a wide range. To converge the energies in time, delayed extraction is used in most cases. The delayed extraction consists of applying a pulsed voltage with a delay of hundreds of nsec from laser irradiation.

A conceptual diagram of a general MALDI ion source and delayed extraction is shown in FIG. 5. A sample is mixed and dissolved in a matrix (such as liquid, crystalline compound, metal powder, or the like). Then, the matrix is solidified and placed on a sample plate. A second lens, a second mirror, and a CCD camera are arranged to permit one to observe the state of the sample. Laser light is directed at the sample via a first lens and a first mirror to vaporize or ionize the sample. The created ions are accelerated by voltages applied to an intermediate electrode and to a base electrode, and are introduced into the mass analyzer.

A sequence of steps for measuring the flight time in a delayed extraction process is also shown in FIG. 5. First, an intermediate electrode and a sample plate are placed at the same potential Vs. Then, after a delay of hundreds of nsec from reception of a signal indicating laser excitation from the laser, the potential Vs at the intermediate electrode 1 is varied to $V_1$ at high speed to create a potential gradient between the sample plate and the intermediate electrode. This accelerates the created ions. The starting time of measurement of flight time is synchronized with the rise time of the pulsed voltage.

[Orthogonal Acceleration TOFMS]

The MALDI technique has a very good affinity with TOFMS because ions are created in a pulsed manner. However, ionization methods for mass spectrometric analysis include numerous methods of continuously creating ions such as electron impact (EI), chemical ionization (CI), electrospray ionization (ESI), and atmospheric-pressure chemical ionization (APCI). Orthogonal acceleration TOFMS has been developed to combine these ionization methods with TOFMS.

A conceptual diagram of TOFMS using orthogonal acceleration is shown in FIG. 6. An ion beam is created from an ion source, which creates ions continuously, and continuously conveyed into an orthogonal accelerator with kinetic energies of tens of eV. In the orthogonal accelerator, a pulsed voltage of plus tens of kV is applied to accelerate the ions in a direction orthogonal to the direction in which the ions are conveyed from the ion source. After the application of the pulsed voltage, the time taken until the ions arrive at the detector differs according to different mass of ion and so mass separation is performed.

[TOF/TOF]

An MS/MS instrument in which two TOFMS instruments are connected in tandem is generally known as a TOF/TOF instrument and chiefly used in an instrument employing a MALDI ion source. A prior art TOF/TOF instrument is composed of a linear TOFMS and a reflectron TOFMS as shown in FIG. 7. An ion gate for selecting precursor ions is interposed between them. The focal point of the first TOFMS is disposed near the ion gate.

There are various kinds of ion gates. A typical ion gate is a parallel-plate type in which two electrodes are placed opposite to each other. Another typical ion gate is the Bradbury-Nielson type in which voltages with different polarities are alternately applied to plural wires. In addition, a method of enhancing the ion selectivity by arranging two ion gates along the flight axis is also proposed (JP-A-2005-302728).

Precursor ions are allowed to fragment spontaneously (i.e., post-source decay (PSD)) in some cases. In other cases, precursor ions are forced to fragment in a collision cell placed ahead of the reflectron field of the first or second TOFMS. The advantages and disadvantages of the MALDI-TOF/TOF mass spectrometer are next described.

Advantages

PRO: 1: It can efficiently measure, using MS/MS technology, samples ionized by a MALDI technique.

PRO: 2: It is one of a very few instruments capable of fragmenting ions with high collision energy (about 20 keV) (see Table 1).

Disadvantages

CON: 1: The precursor ion selectivity is low.

CON: 2: The mass resolution and the mass accuracy of the MS2 are low.

CON: 3: Since product ions produced by PSD fragmentation and product ions produced by CID fragmentation are mixed, the resulting spectrum is complicated and difficult to analyze.

CON: 4: It is possible to select only one precursor ion. This leads to wasteful consumption of the sample.

Some reports of methods of overcoming the CONs 1 and 2 have been made as described later. However, CONs 3 and 4 are the fundamental drawbacks with prior art TOF/TOF and, therefore, it is difficult to solve these drawbacks.

[Problem 1 with Prior Art]

A first problem with the prior art is that the precursor ion selectivity is low. The precursor ion selectivity is associated with the effective flight time of TOF1 and with the performance of the ion gate. Often, the first MS of the prior art TOF/TOF instrument is a linear TOFMS as mentioned previously. Therefore, the effective flight distance is about 0.5 m. It is necessary to take account of the performance of the ion gate from spatial and timewise viewpoints. FIGS. 8A and 8B show the differences of the times in which ions having m/z of 999, 1,000, and 1,001 and kinetic energies of 20.0 keV and 19.9 keV arrive at positions of 0.3 m ahead and behind from the TOF1 focal point for ions from the time in which ions having m/z of 1,000 and kinetic energy of 20.0 kV arrive at the same positions in a case where the effective flight time of TOF1 is set to 0.5 m. The focal point (0 m in the horizontal axis) is the focal point of TOF1. It can be seen that ions having the same m/z value but different kinetic energies arrive at the same time.

It can be seen from the figures that ions differing in m/z by one unit show no time difference at the positions of 0.1 m ahead and behind and thus overlap each other. That is, it is impossible to separate these ions however short the response time of the ion gate. Furthermore, at positions located within 0.1 mm ahead and behind from the focal point where there is no overlap, the time difference is about 5 ns per m/z. In addition, the spatial difference is only 0.5 mm. Consequently, the ions cannot be separated. As a result, there is the restriction that the ion gate must be placed close to the focal point of TOF1. Moreover, the precursor selectivity of TOF/TOF is approximately 2 units in the neighborhood of m/z.

[Problem 2 with Prior Art]

A second problem with the prior art is that the mass resolution and mass accuracy of MS2 are low. The reason why the mass resolution and mass accuracy of MS2 are low is closely related to the problem 1 and to high-energy CID that is an advantage of the TOF/TOF instrument.

The kinetic energy $U_{pro}$ of a product ion produced by collision-induced dissociation can be given by $$U_{pro}=(m/M_{pre})\times U_{pre}$$

where $U_{pre}$ is the kinetic energy of the precursor ion, $M_{pre}$ is the mass of the precursor ion, and m is the mass of the product ion. For example, where the accelerating voltage is 20 kV and the valence of the precursor ion is 1, kinetic energy $U_{pre}$ is 20 kV and so, in principle, product ions having kinetic energies of 0 to 20 keV are created by fragmentation.

In this way, some methods have been proposed to converge ions having a wide range of kinetic energies. In one method (U.S. Pat. No. 6,441,369), the distribution of kinetic energies is suppressed by deceleration, fragmentation, and acceleration. In another method (U.S. Pat. No. 6,300,627), the potential in a certain space is varied quickly after fragmentation, and then ions are again accelerated. In a further method (U.S. Pat. No. 4,625,112), an electric field gradient-type reflectron field is employed. In still another method (JP-A-2006-196216), reacceleration and an offset parabolic ion mirror (reflectron field formed by a linear electric field and a parabolic electric field) are combined. However, with these methods, it is difficult to converge all the ions having a very wide range of kinetic energies. Generally, MS/MS measurements result in poorer mass resolving power than MS measurements using reflectron TOFMS.

The resolving power is deteriorated due to the structure of TOF/TOF instrument. As described previously in connection with the prior art, TOFMS is based on the assumption that all ions are at the same position at some measurement start time except for the initial distribution. However, where TOFMS instruments are connected in tandem, not all ions are identical in initial position because ions with different m/z are separated by TOF1 and because plural ions having different m/z values are introduced into the second TOFMS due to poor precursor ion selectivity. Consequently, the mass resolution and mass accuracy of TOF2 are deteriorated.

[Problem 3 with Prior Art]

A third problem with the related art is that the results of MS/MS measurement are complex. The maximum advantage of a TOF/TOF instrument is that it is one of a few instruments capable of high-energy CID. However, it is known that in the MALDI technology, a PSD (post-source decay) takes place generally. The fragment pathways of a PSD process are close to the pathways of low-energy CID. Furthermore, in the prior art TOF/TOF instrument, TOF1 is a linear TOFMS and so it is impossible to separate PSD ions. Therefore, fragmentations due to CID and PSD are simultaneously reflected in MS/MS measurement results. As a result, as pointed out in Problem 2, the MS/MS spectrum becomes very complex because of low resolution of MS2. In consequence, it is difficult to analyze the spectrum.

[Problem 4 with Prior Art]

A fourth problem with the prior art is that it is possible to measure the fragment pathway from only one precursor ion during one MS/MS measurement. Table 2 shows the results of calculations of the relationship between the mass of the first precursor ions and the mass of a precursor ion capable of being selected next in a case where plural precursor ions are selected in MS/MS measurements using a TOF/TOF instrument in which a prior art linear TOFMS and reflectron-type TOFMS are combined. L1 is the effective flight distance of the first (linear) TOFMS. L2 is the effective flight distance of the first (reflectron type) TOFMS. In the computation, L1/L2 was set to 0.5

TABLE 2

| mass of precursor ion selected first | mass of precursor ion capable of being selected next; in a case where L1/L2 = 0.5 |
|---|---|
| 500 | 4,500 |
| 600 | 5,400 |
| 700 | 6,300 |
| 800 | 7,200 |
| 900 | 8,100 |
| 1,000 | 9,000 |
| 1,100 | 9,900 |
| 1,200 | 10,800 |
| 1,300 | 11,700 |
| 1,400 | 12,600 |
| 1,500 | 13,500 |

As can be seen from Table 2, the difference in mass between the first selected precursor ion and the next selected precursor ion is great. It has been effectively impossible to select plural precursor ions in one measurement. That is, since all the ions excluding the selected precursor ions are eliminated, the sample is consumed wastefully.

SUMMARY OF THE INVENTION

In view of the foregoing, it is an object of the present invention to provide a novel TOF/TOF instrument which overcomes the problem with the prior art TOF/TOF instrument while making use of the advantages of the prior art TOF/TOF instrument. It is another object of the present invention to provide a method implemented in this novel TOF/TOF instrument.

One embodiment of the present invention provides a tandem time-of-flight mass spectrometer having: an ion source for ionizing a sample; accelerator for accelerating the created ions in a pulsed manner; a first time-of-flight (TOF) mass spectrometer composed of plural electric sectors and having a spiral trajectory in which the accelerated ions are made to travel spirally; an ion gate placed in the first TOF mass spectrometer and selecting only ions having a certain mass-to-charge ratio; a collision cell placed downstream of the ion gate and filled with a gas to fragment the selected ions; a second time-of-flight (TOF) mass spectrometer of the reflectron type placed downstream of the collision cell and analyzing the masses of the fragmented ions; and a detector for detecting ions passed through the second TOF mass spectrometer. The first TOF mass spectrometer satisfies spatial focusing conditions for the direction of flight and for a plane orthogonal to the direction of flight each time ions make a turn in the spiral trajectory. The ion gate is placed in the spiral trajectory within the first TOF mass spectrometer. The ions selected by the ion gate pass the electric sectors placed downstream of the ion gate and enter the collision cell.

In one feature of the present invention, a second detector capable of moving into and out of the ion trajectory is mounted between the first and second TOF mass spectrometers.

In another feature of the present invention, a further detector is mounted to detect ions passed through the first TOF mass spectrometer. The electric sector interposed between this detector and the ion gate is provided with a hole to permit passage of ions. The collision cell and the second TOF mass spectrometer are so arranged that ions passed through the hole enter the collision cell.

Supply of power to a hierarchical layer including the ion passage hole in the electric sector can be shut off independent of the other hierarchical layers. Where a tandem mass analysis is performed by the first and second TOF-MSs, supply of power to the hierarchical layer is shut off, and the ions are permitted to pass through the hole.

In a further feature of the present invention, the time at which the power supply is shut off is the timing at which precursor ions pass.

In yet another feature of the present invention, two ion gates are disposed in the same free space in the spiral trajectory. A voltage for turning on and off the gates is supplied from the same power supply.

In an additional feature of the present invention, two ion gates are disposed at the same angular position in different free spaces in the spiral trajectory. A voltage for turning on and off the gates is supplied from the same power supply.

In still another feature of the present invention, plural ion gates are disposed at plural positions at the same angular position in different free spaces in the spiral trajectory.

After the ions have passed through all the ion gates, the ions are made to pass through electric sectors.

In an additional feature of the present invention, a deceleration region is placed upstream of the collision cell, and a reacceleration region is placed downstream of the collision cell.

In an additional feature of the present invention, the reflectron field in the second TOF-MS is an ion mirror having a curved potential distribution.

In an additional feature of the present invention, a reacceleration region is placed downstream of the collision cell. The reflectron field in the second TOF-MS is an ion mirror having a potential distribution having a shape that is a tandem combination of a straight line and a parabolic line.

In a reflectron field formed by plural electrodes, in a case where voltages supplied to the electrodes are divisionally supplied by two power supplies of opposite polarities and a resistor connecting the adjacent electrodes, one electrode sandwiched between two electrodes at both ends is set to ground potential. The two power supplies are connected with electrodes at the opposite ends. The polarities of the two power supplies are located on the opposite sides of ground potential.

In an additional feature of the present invention, the sample is ionized in the ion source by irradiating the sample on a conductive sample plate with laser light.

In an additional feature of the present invention, the sample is ionized in the ion source by a MALDI technique.

In an additional feature of the present invention, the ions are accelerated by delayed extraction.

In an additional feature of the present invention, the accelerator for accelerating the ions out of the ion source in a pulsed manner is an orthogonal acceleration method of conveying the ions created in the ion source of the continuous type with low energies and accelerating the ions in a pulsed manner.

A method of tandem time-of-flight mass spectrometry according to one embodiment of the present invention is implemented to perform MS/MS measurements by selecting plural precursor ions in one time-of-flight measurement using the above-described tandem time-of-flight mass spectrometer.

In an additional feature of the present invention, the plural precursor ions are all monoisotopic ions.

The tandem time-of-flight mass spectrometer according to one embodiment of the present invention has: an ion source for ionizing a sample; accelerator for accelerating the ions in a pulsed manner; a first time-of-flight (TOF) mass spectrometer composed of plural electric sectors and having a spiral trajectory in which the accelerated ions are made to travel spirally; an ion gate placed in the first TOF mass spectrometer and selecting only ions having a certain mass-to-charge ratio; a collision cell placed downstream of the ion gate and filled with a gas to fragment the selected ions; a second time-of-flight (TOF) mass spectrometer of the reflectron type placed downstream of the collision cell and analyzing the masses of the fragmented ions; and a detector for detecting ions passed through the second TOF mass spectrometer. The first TOF mass spectrometer satisfies spatial focusing conditions for the direction of flight and for a plane orthogonal to the direction of flight each time ions make a turn in the spiral trajectory. The ion gate is placed in the spiral trajectory within the first TOF mass spectrometer. The electric sectors are placed downstream of the ion gate. Therefore, a novel tandem time-of-flight mass spectrometer can be offered which makes use of the advantages of the prior art tandem time-of-flight mass spectrometer and overcomes the drawbacks.

In the method of tandem time-of-flight mass spectrometry according to one embodiment of the present invention, MS/MS measurements are performed while selecting plural precursor ions in one time-of-flight measurement using the tandem time-of-flight mass spectrometer. Therefore, a novel method of tandem time-of-flight mass spectrometry can be offered which makes use of the advantages of the prior art method of tandem time-of-flight mass spectrometry and which overcomes the drawbacks.

These and other objects and advantages of the present invention will become more apparent as the following description proceeds.

DESCRIPTION OF THE PREFERRED EMBODIMENTS

The preferred embodiments of the present invention are hereinafter described with reference to the drawings. In the following description, the invention is applied to a mass spectrometer apparatus including a first TOF-MS utilizing a spiral trajectory TOF-MS formed by four electric sectors. The multiple reflection type having a zigzag trajectory can be similarly utilized. Furthermore, in the following description, a MALDI process is applied to the ion source. In addition, an orthogonal acceleration method may be similarly applied to a case using a continuous ion source. Further, in the following description, the second TOF-MS employs reacceleration and an offset parabolic ion mirror. Instead, other methods of compressing kinetic energies and other ion mirrors may be used.

First Embodiment

Figure 1:
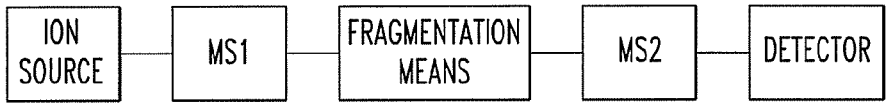
FIG.1 PRIOR ART
FIG. 1 is a diagram showing one prior art MS/MS instrument.
Figure 2:
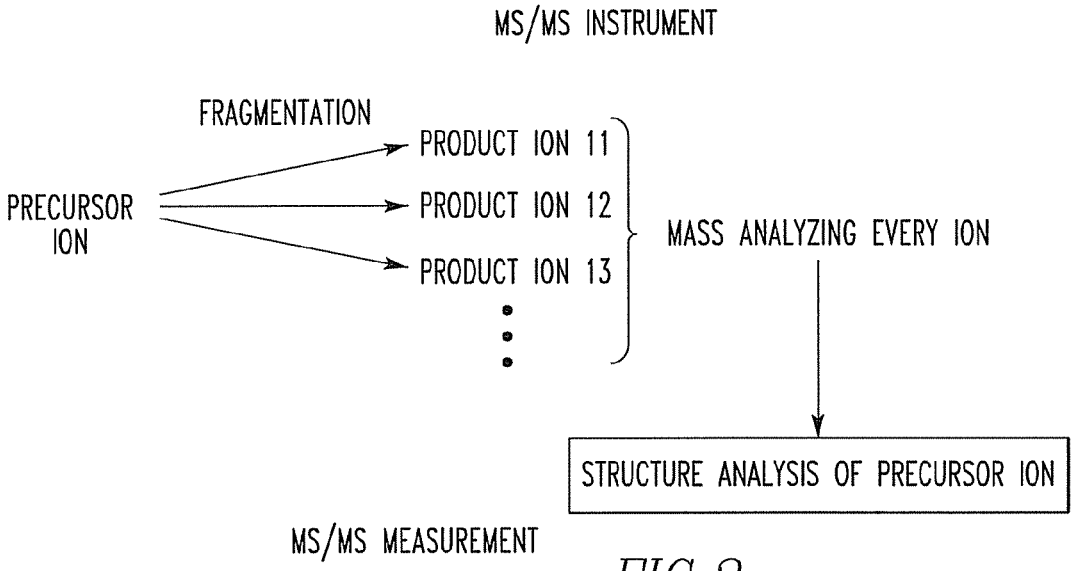
FIG.2 PRIOR ART
FIG. 2 is a diagram illustrating one prior art MS/MS measurement.
Figure 3:
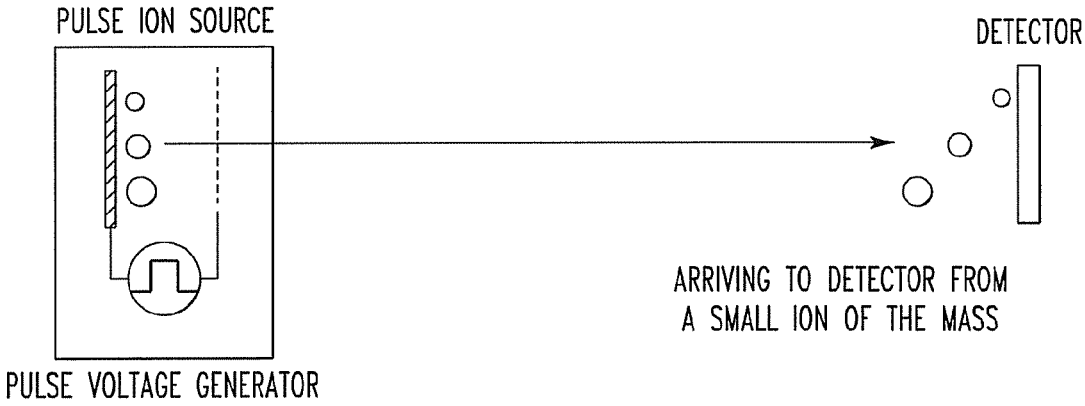
FIG.3 PRIOR ART
FIG. 3 is a diagram illustrating a prior art linear TOFMS instrument.
Figure 4:
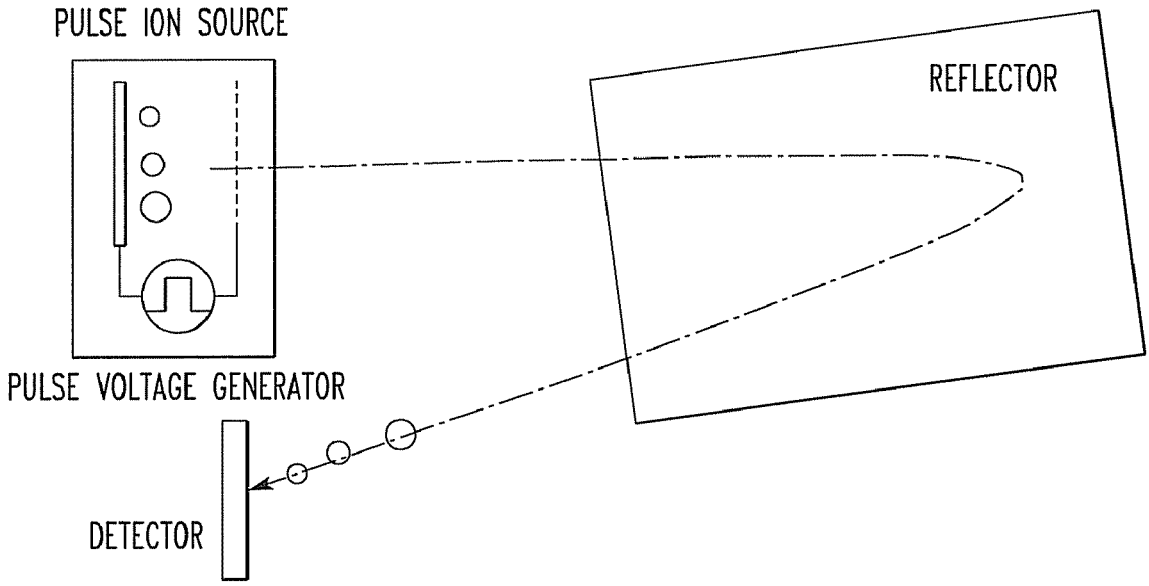
FIG.4 PRIOR ART
FIG. 4 is a diagram of a prior art reflectron TOFMS instrument.
Figure 5:
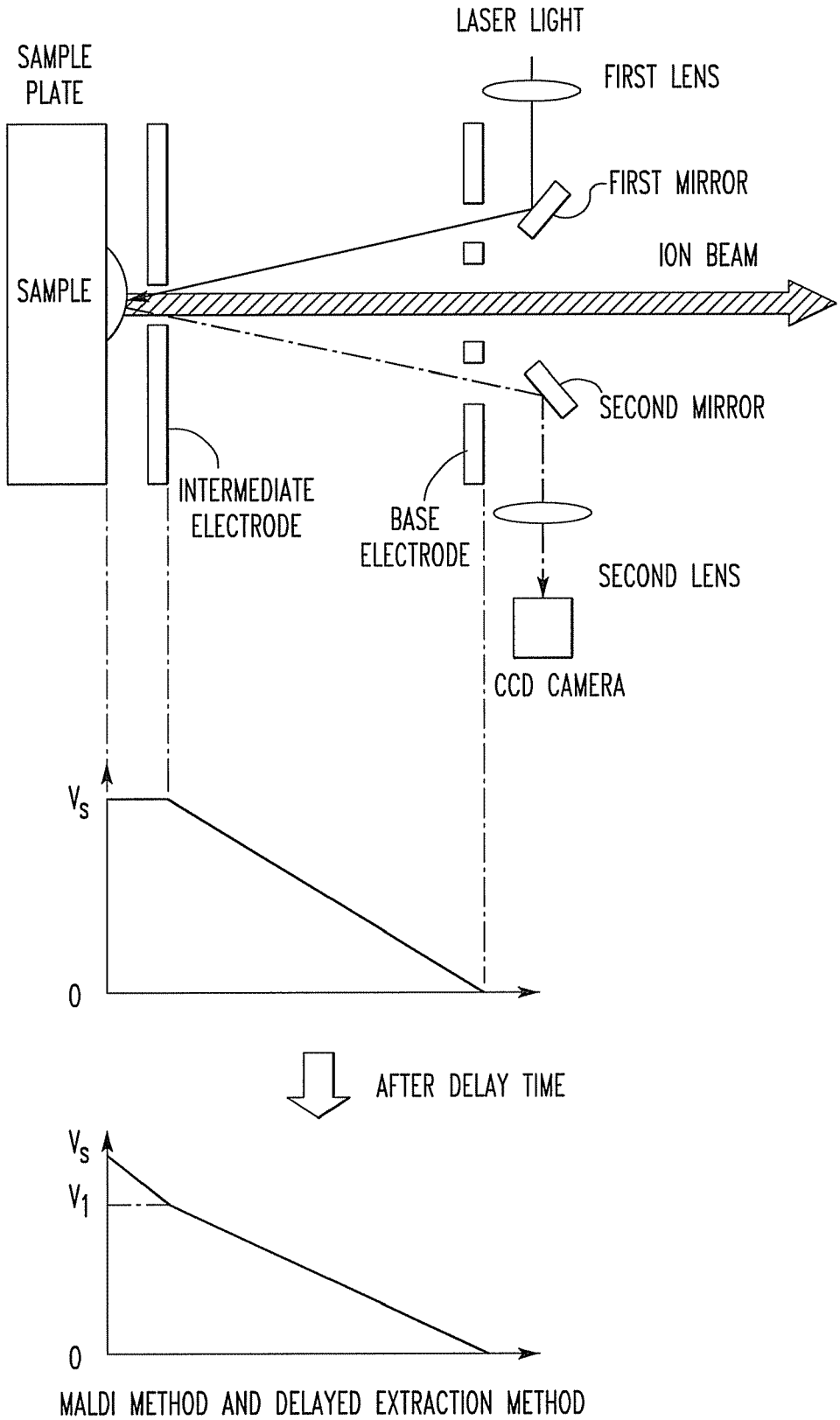
FIG.5 PRIOR ART
FIG. 5 is a diagram of a prior art MALDI ion source.
Figure 6:
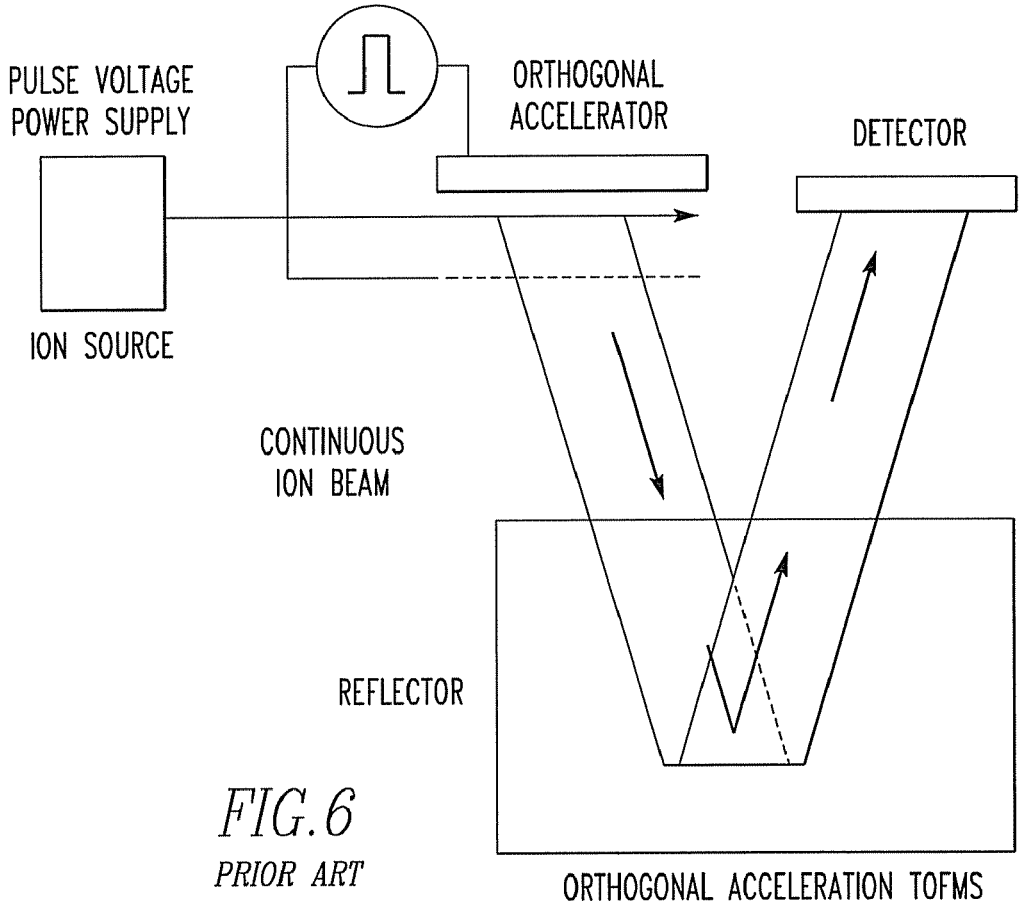
FIG. 6 PRIOR ART
FIG. 6 is a diagram of a prior art orthogonal acceleration TOFMS instrument.
Figure 7:
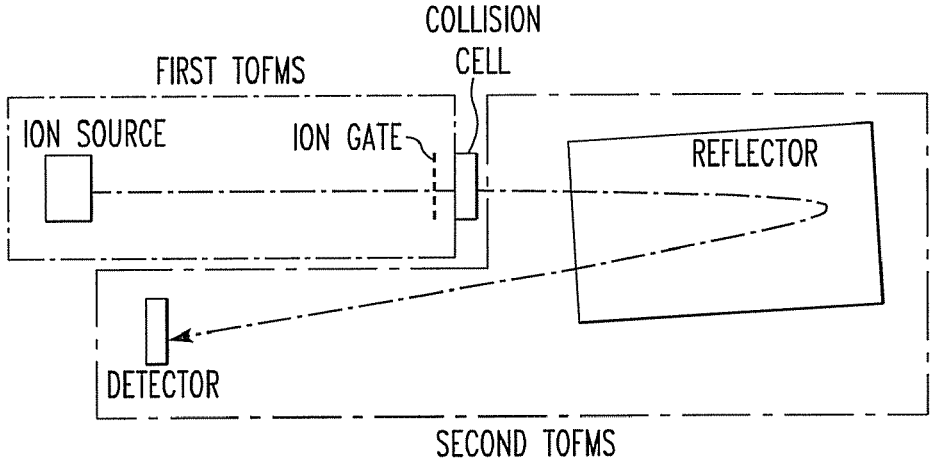
FIG. 7 PRIOR ART
FIG. 7 is a diagram of a prior art TOF/TOF instrument.
Figure 8A:
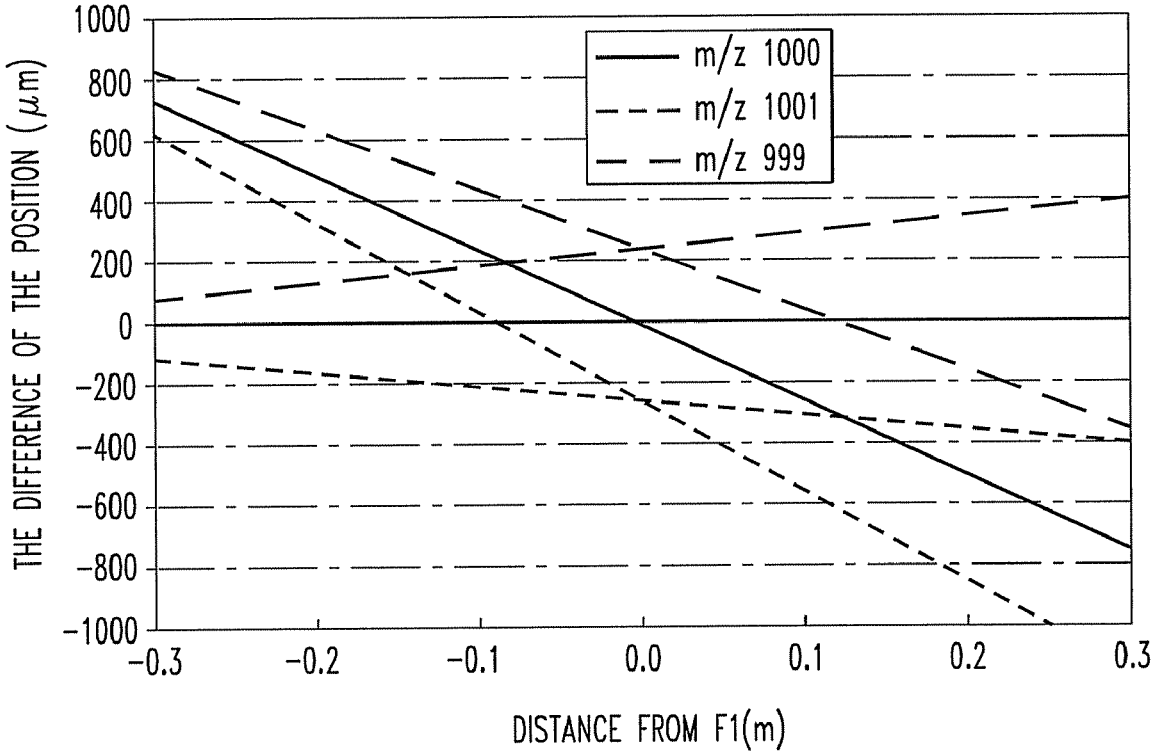
FIGS. 8A and 8B show graphs illustrating one example of precursor ion selectivity obtained by the prior art.
Figure 8B:
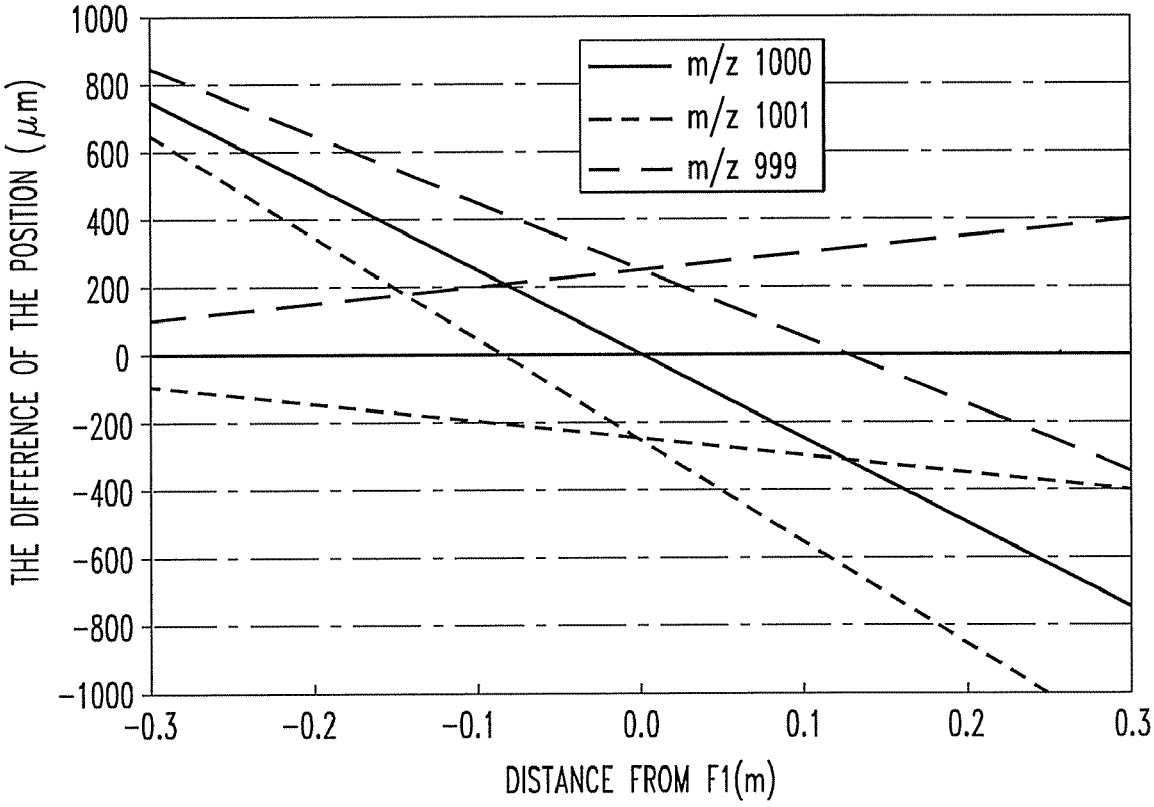
Figure 9A:
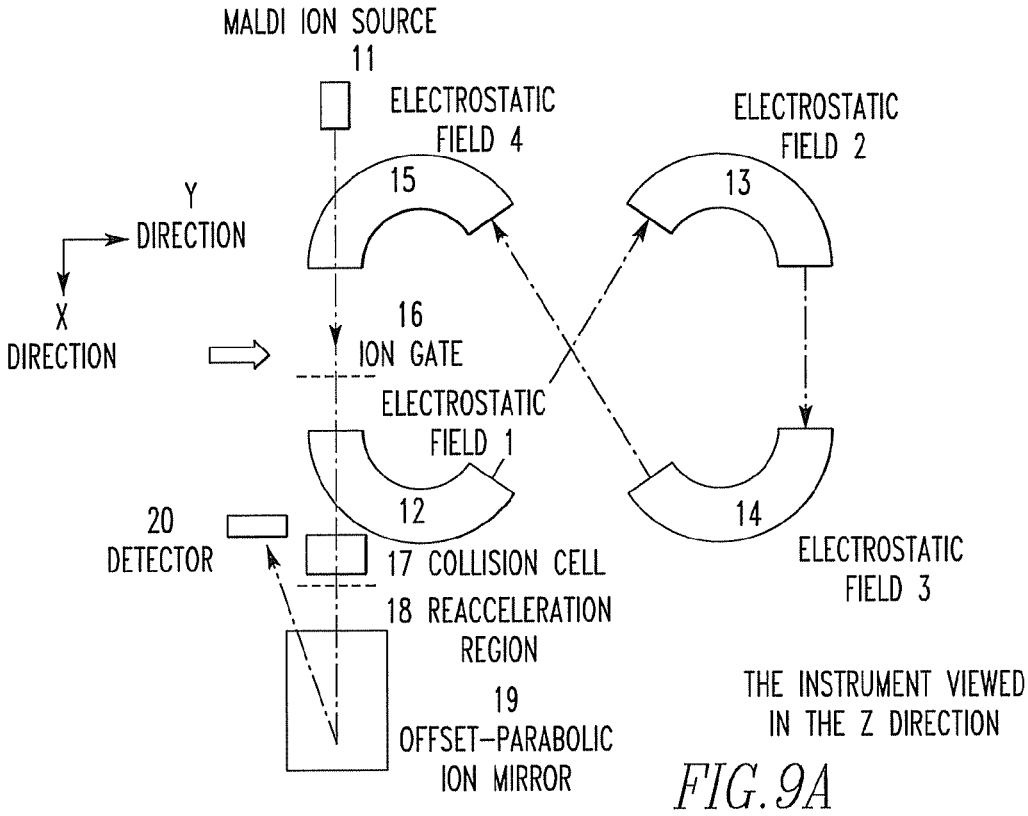
FIGS. 9A and 9B are diagrams illustrating a TOF/TOF instrument according to one embodiment of the present invention.
Figure 9B:
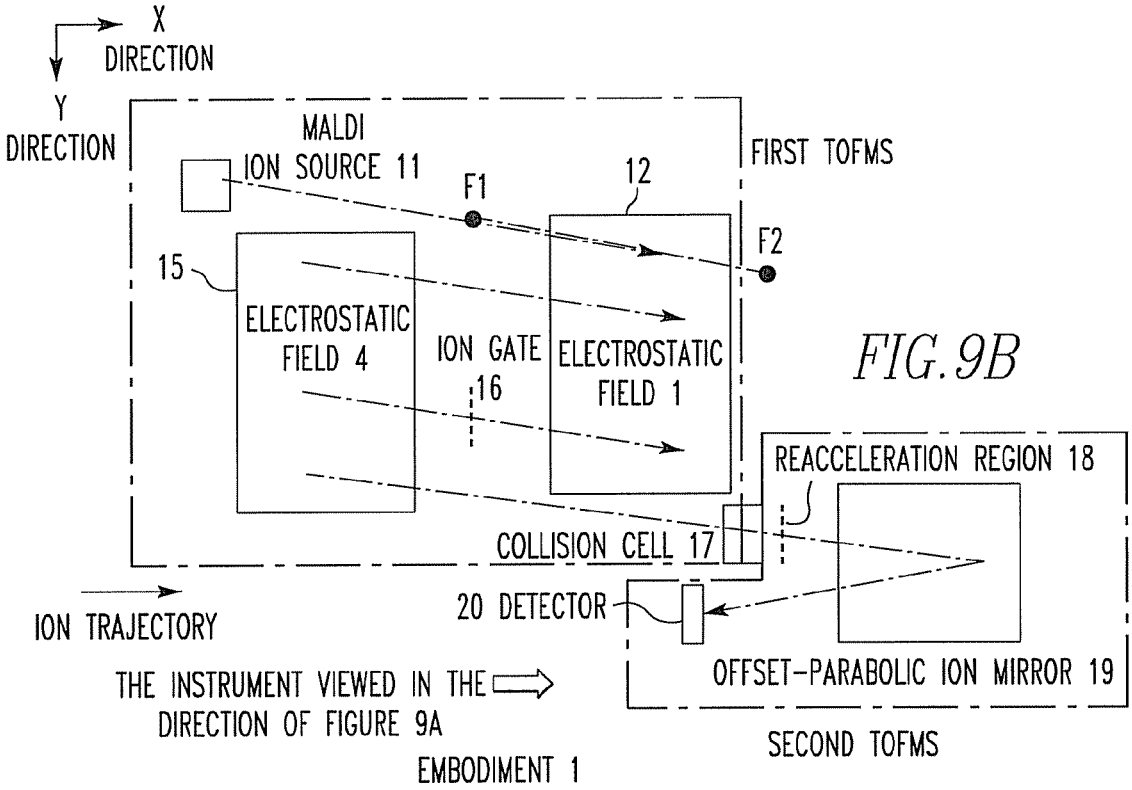

FIGS. 9A and 9B show a tandem time-of-flight mass spectrometer according to a first embodiment of the present invention. In FIG. 9A, the instrument is viewed in the Z-direction. In FIG. 9B, the instrument is viewed in the direction indicated by arrows (Y-direction) in FIG. 9A. The spectrometer has a MALDI ion source 11, electric sectors 12-15 stacked on top of each other in the Z-direction to form an 8-shaped spiral trajectory, an ion gate 16 for selecting precursor ions, a collision cell 17 for fragmenting ions, an ion reacceleration region 18 formed between a spiral trajectory TOF-MS (hereinafter may be referred to as the first TOF-MS) and reflectron TOF-MS (hereinafter may be referred to as the second TOF-MS) and using a constant voltage or a pulsed voltage, a reflectron field 19 into which ions fragmented in the collision cell 17 are admitted, and a detector 20 for detecting ions reflected by the reflectron field 19. In this embodiment, the reflectron field is formed by an offset parabolic ion mirror. An ion deceleration region may be formed upstream of the collision cell 17.

A significant feature of the present embodiment is that some of the electric sectors are placed downstream of the ion gate 16 and operated as a mass filter to prevent product ions produced by spontaneous fragmentation of ions after passing through the gate 16 from passing toward the second TOF-MS. The operation of the instrument designed in this way is described below.

First, the compounds of a sample are ionized in the MALDI ion source. The resulting ions are accelerated by delayed extraction. The ion optics of the first TOF-MS are so designed that spatial focusing conditions for the direction of flight and a direction orthogonal to the direction of flight are satisfied whenever ions make a turn in the 8-shaped spiral trajectory. The second TOF-MS has kinetic energy focusing capabilities. A focal point F1 formed by the delayed extraction is set at the starting point of the reacceleration region 18. The ions of the sample are separated according to mass-to-charge ratio while traveling through the first TOF-MS and the second TOF-MS. In the case of MS measurements, the separated ions are detected by the detector 20.

As described previously, in the prior art TOF/TOF, an ion gate must be placed near this focal point. In addition, precursor ion selectivity is very low. In contrast, in one embodiment of the present invention, the spiral trajectory TOF-MS is adopted as the first TOF-MS. Consequently, the effective flight distance to the ion gate can be prolonged. Hence, high precursor ion selectivity can be accomplished irrespective of the focal point.

Figure 10A:
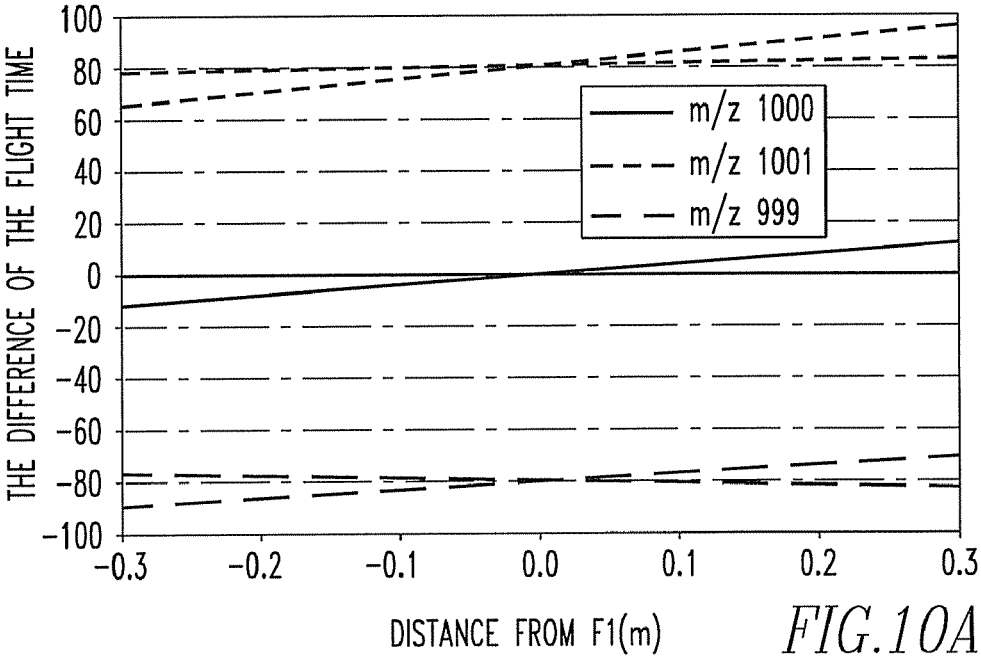
FIGS. 10A and 10B show graphs illustrating one example of precursor ion selectivity obtained in the present invention.
Figure 10B:
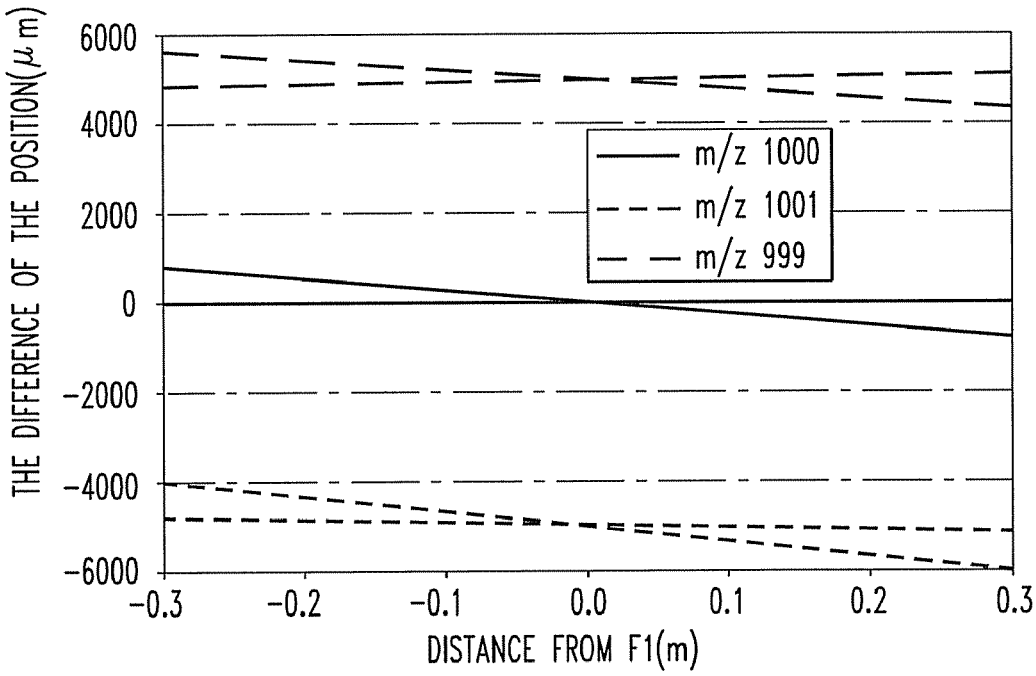

FIGS. 10A and 10B show differences of arrival times of ions having m/z values of 999, 1,000, and 1,001 and kinetic energies of 20.0 keV and 19.9 keV at positions located 0.3 m ahead and behind from the first TOF-MS focal point for ions from arrival times of ions having m/z values of 1,000 and kinetic energy of 20.0 kV in a case where the effective flight distance (distance to F1+length of the circular trajectory) to the focal point is set to 10 m. Ion packets at the position of the ion gate assume the same state as at the position of F2. Assuming that the difference between the distance to F1 and the distance to F2 is about 0.2 to 0.3 m, the ion gate is located within the range of from −0.2 m to −0.3 m in the figure. As can be seen from FIGS. 10A and 10B, even at a distance of about 0.2 m from the focal point F1, ions differing by one unit of m/z are well separated spatially and in time. Consequently, high precursor ion selectivity can be realized. Since severe restrictions are imposed on deviations of the position and angle permitting ions to pass through an electric sector, higher precursor ion selectivity can be obtained than with a simple ion gate by placing the aforementioned ion gate 16 upstream of the electric sector.

The selected precursor ions enter the collision cell 17 and collide with the gas filled in the cell, thus inducing fragmentation. As a result, product ions are created. At this time, the electric sectors forming the first TOF-MS have the function of a kinetic energy filter and, therefore, ions created by fragmentation by a PSD process during travel through the first TOF-MS can be eliminated, that is, a mass spectrum consisting only of high-energy CID fragment ions.

All the product ions and precursor ions are reaccelerated in the reacceleration region 18 by the constant voltage or pulsed voltage. The kinetic energies are compressed and then the ions are separated according to m/z value in the second TOF-MS that is composed of the offset parabolic ion mirror 19 (reflectron field), free spaces located ahead and behind the mirror 19, and the detector 20. The separated ions are detected by the detector 20.

Mass spectra derived from normal organic substances are observed to contain isotopic peaks arising from isotopes of the constituent elements. Among the isotopic peaks, the peaks with the minimum mass, i.e., ions consisting only of isotopes with the least mass out of the constituent elements, are referred to as monoisotopic ions. Peaks indicating the monoisotopic ions are referred to as monoisotopic peaks.

Figure 11:
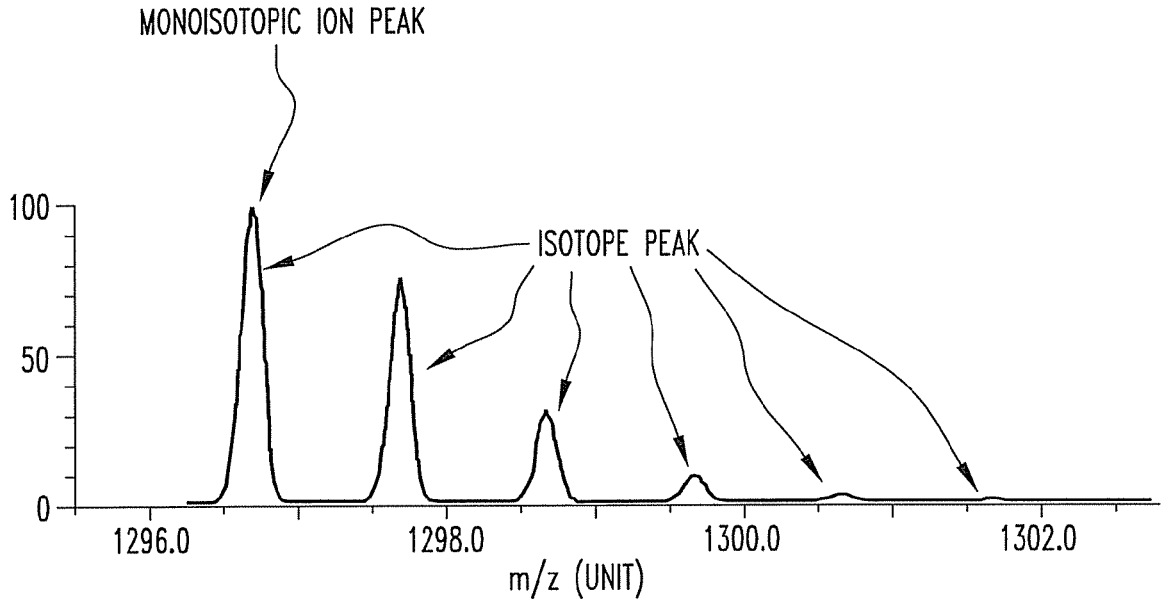
FIG. 11 is a mass spectrum of angiotensin I including isotopic peaks and a monoisotopic peak.

FIG. 11 is a mass spectrum containing isotopic peaks and a monoisotopic peak of angiotensin I ($C_{62}H_{90}N_{17}O_{14}^{+}$). The advantage of high precursor ion selectivity is conspicuous where monoisotopic ions consisting only of isotopes of the minimum mass number out of the constituent components are selected. That is, the product ions are also composed of isotopes of the least mass and, therefore, only one peak appears for one composition. Consequently, a complex MS/MS structure of complex CID fragmentation ions can be simplified.

Where a MALDI process is used, a large amount of matrix-derived ions are observed at m/z<500 in MS measurements. The aforementioned ion gate can also be used to eliminate high-intensity ions, such as matrix-derived ions.

Second Embodiment

Figure 12A:
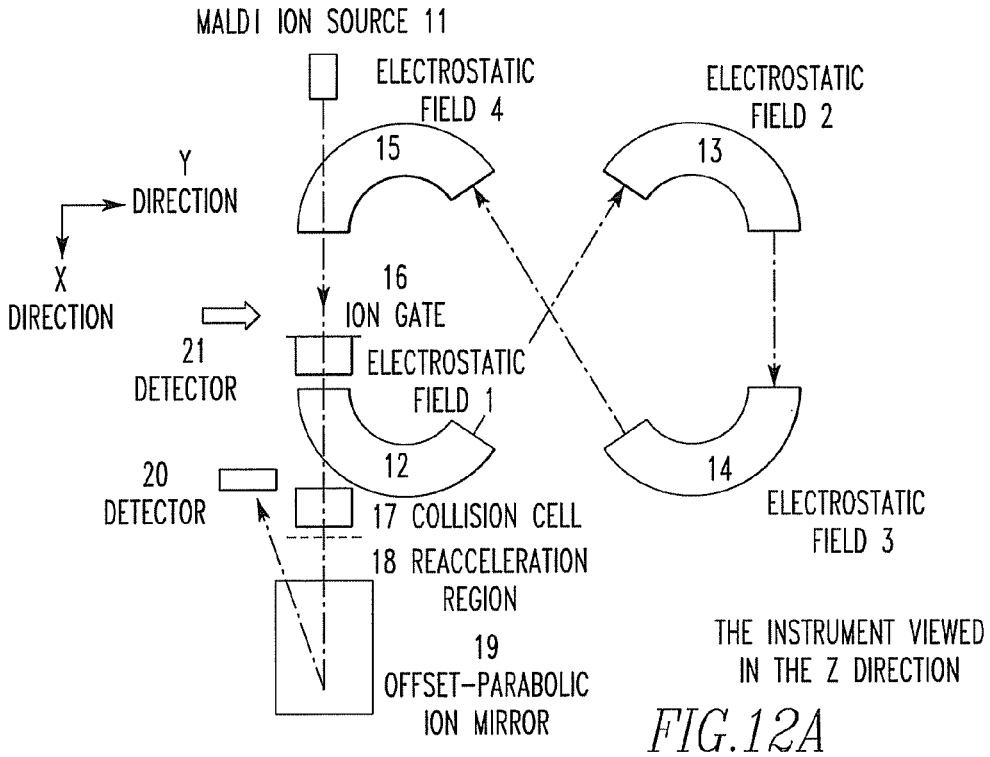
FIGS. 12A and 12B are diagrams of a TOF/TOF instrument according to another embodiment of the present invention.
Figure 12B:
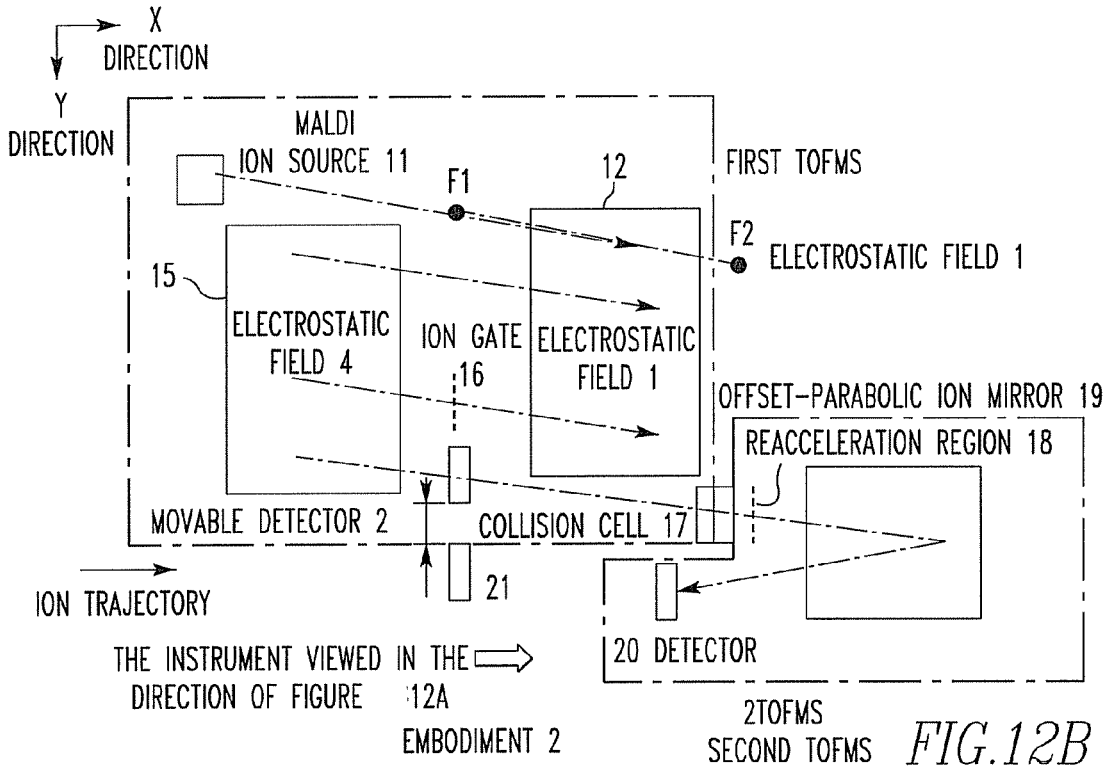

The present embodiment is similar to the first embodiment except that a detector 21 for MS measurements is added as shown in FIGS. 12A and 12B. Normally, the diameters of ion exit and entrance ports in the collision cell 17 are about 1 mm to secure airtightness. Therefore, there is the possibility that detecting ions passed through the collision cell 17 in MS measurements is disadvantageous in terms of sensitivity. Furthermore, as described previously, the mass dependence of the mass resolution during MS measurements can be reduced by shortening the distance from the sample plate to the focal point used in delayed extraction. For these reasons, better data can be effectively obtained in both MS measurement and MS/MS measurement by varying the focal point used in delayed extraction.

First, the compounds of a sample are ionized in the MALDI ion source. The resulting ions are accelerated by delayed extraction. The ion optics of the first TOF-MS are so designed that spatial focusing conditions for the direction of flight and a direction orthogonal to the direction of flight are satisfied whenever ions make a turn in the 8-shaped spiral trajectory. That is, the focal point formed by delayed extraction may be set at the position F2 corresponding to the position of the detector 21 in the final turn of the spiral trajectory. The ions of the sample are separated according to mass-to-charge ratio by the first TOF-MS having the spiral trajectory. In the case of MS measurements, the separated ions are detected by the detector 21. Where a MALDI process is used, a large amount of matrix ions is often produced. High-intensity ions, such as matrix ions, can be eliminated by the ion gate 16 disposed in the spiral trajectory preceding the detector 21.

In the case of MS/MS measurements, the detector 21 is moved off the ion trajectory, and ions are permitted to pass. Measurement conditions are so set that the focal point formed by delayed extraction is the position F2 to bring the starting point of the reacceleration region 18 that is the starting point of the second TOF-MS into the focal point. As described in the first embodiment, ions differing by one unit of m/z are well separated spatially and in time near positions that are closely spaced about 0.2 to 0.3 m from the focal point F1. High precursor ion selectivity can be accomplished by arranging the ion gate in these positions.

The selected precursor ions enter the collision cell 17 and collide with the gas filled in the cell, resulting in fragmentation. As a result, product ions are created. At this time, the electric sectors forming the first TOF-MS have the function of a kinetic energy filter and, therefore, ions created by fragmentation by a PSD process during travel through the first TOF-MS can be eliminated. That is, a mass spectrum consisting only of high-energy CID fragment ions can be obtained.

All the product ions and precursor ions are reaccelerated in the reacceleration region 18 by the constant voltage or pulsed voltage. The kinetic energies are compressed and then the ions are separated according to m/z value in the second TOF-MS that is composed of the offset parabolic ion mirror 19, free spaces located ahead and behind the mirror 19, and the detector 20. The separated ions are detected by the detector 20.

Third Embodiment

Figure 13A:
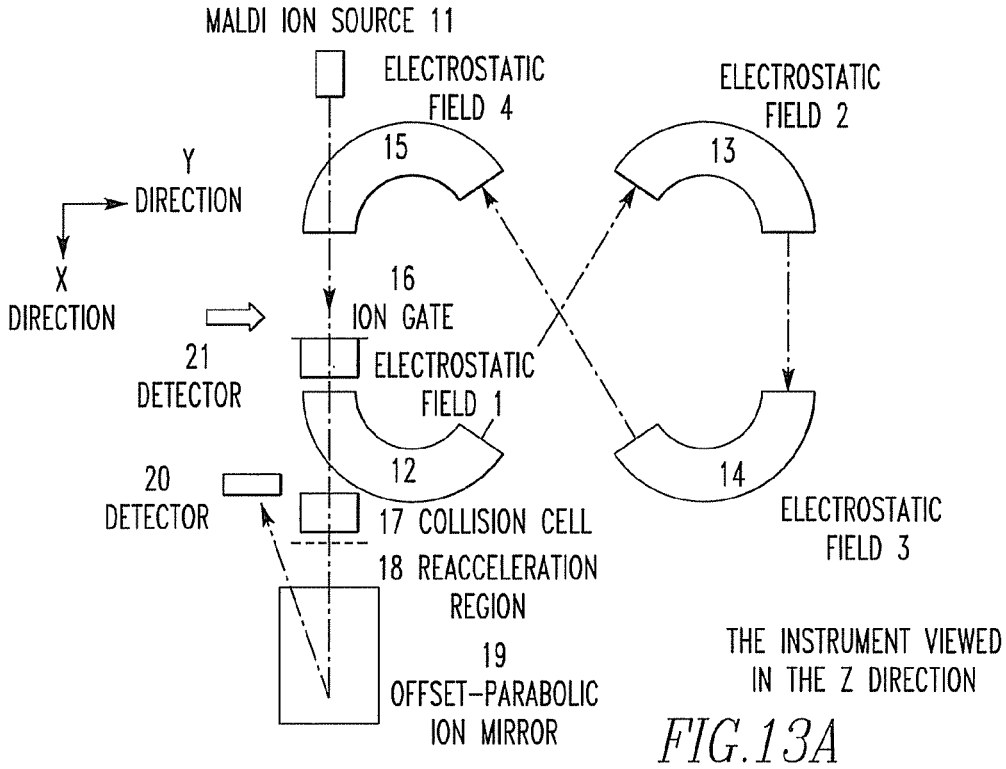
FIGS. 13A and 13B are diagrams of a TOF/TOF instrument according to a further embodiment of the present invention.
Figure 13B:
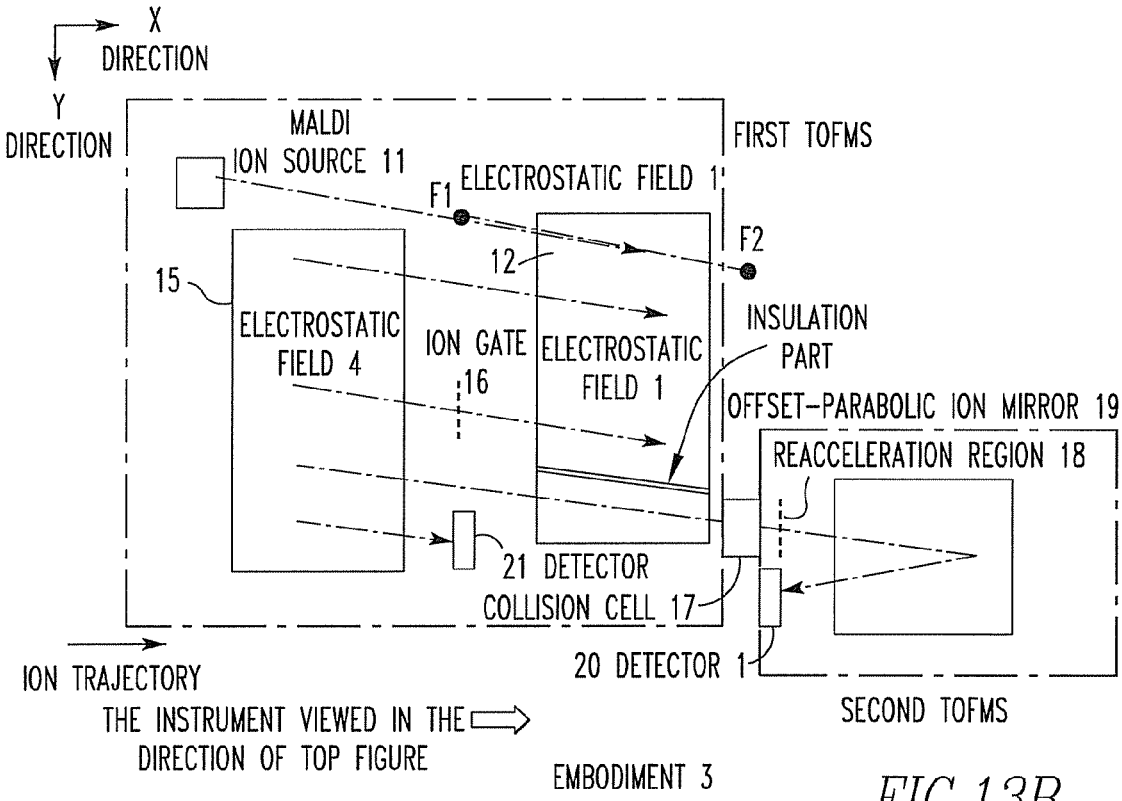

The present embodiment is a partial modification of the second embodiment as shown in FIGS. 13A and 13B. In the present embodiment, an ion passage hole 22 is formed in an electric sector that is located upstream of the circular path where the detector 21 is disposed and downstream of the circular path where the ion gate 16 is disposed. The collision cell 17, reacceleration region 18, offset parabolic ion mirror 19, and detector 20 are disposed on a straight line that is an extension of the flight trajectory extending straight from the ion passage hole.

In the case of MS measurements, a voltage is applied to the electric sector having the ion passage hole 22. The ions are made to travel in the spiral trajectory without permitting the ions to pass through the passage hole 22. In the case of MS/MS measurements, the electric field produced by the electric sector needs to be eliminated to permit the ions selected by the ion gate 16 to pass through the ion passage hole 22. Where all hierarchical layers of the stacked electric sectors forming the 8-shaped spiral trajectory are electrically connected and voltages are supplied from the same power supply, the voltages may be turned off only at the instant when the selected precursor ions pass. Where only the hierarchical layer having the ion passage hole is electrically insulated from other hierarchical layers, the mode of operation may be switched between MS measurement mode and MS/MS measurement mode by arranging a switch for turning on and off the voltage in the former hierarchical layer.

Fourth Embodiment

Figure 14A:
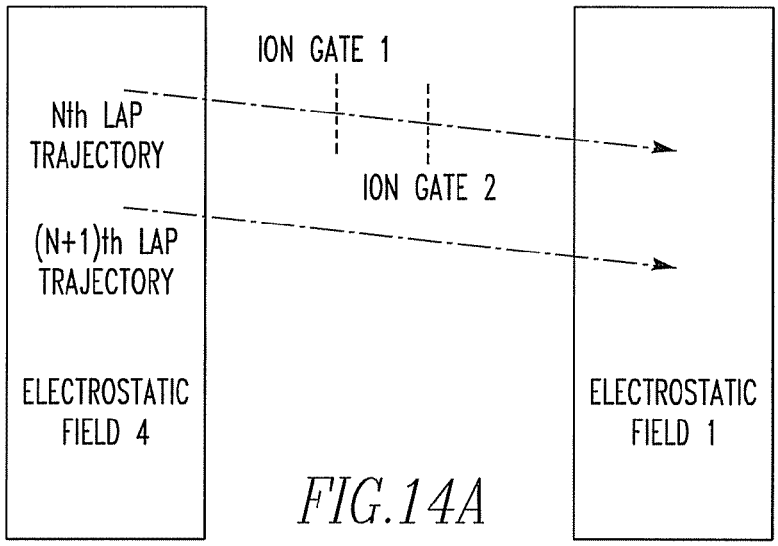
FIGS. 14A, 14B, and 14C are diagrams of an ion gate according to one embodiment of the present invention.
Figure 14B:
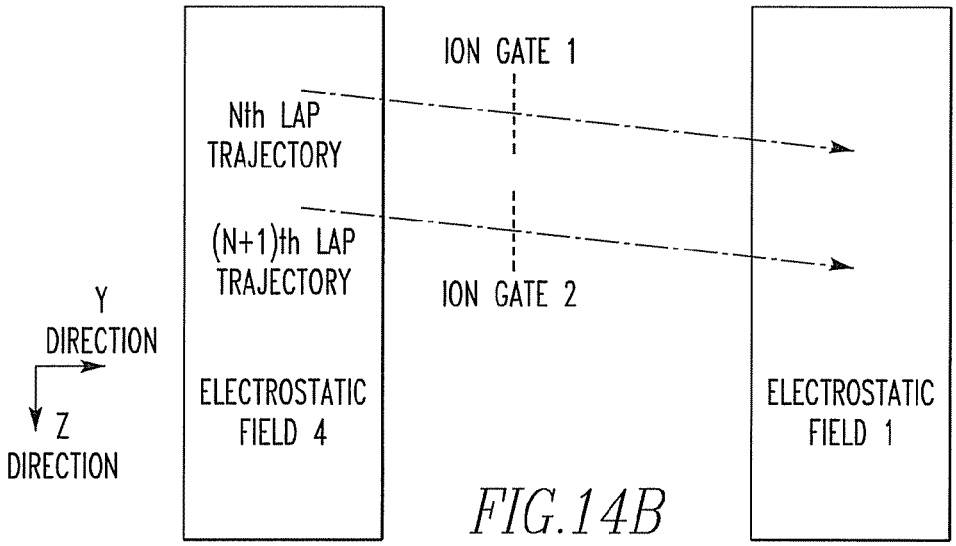
Figure 14C:
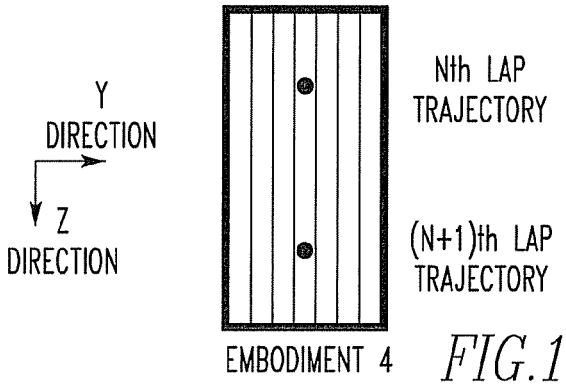

The present embodiment is similar to the first through third embodiments except that the ion gate has been modified as shown in FIGS. 14A, 14B, and 14C. The instrument, according to the first embodiment, has precursor ion-selecting capabilities of separating ions differing by one unit of m/z. It is also necessary to shorten the response time of the ion gate to achieve miniaturization of the instrument and higher selectivity. In this case, as already described in connection with the prior art, a method using two ion gates is available. For example, ions having m/z values smaller than the m/z values of precursor ions to be selected are eliminated by the ion gate closer to the MALDI ion source, and ions having m/z values greater than the m/z values of the precursor ions are eliminated by the ion gate closer to the detector.

As described in the first through third embodiments, in the prior art TOF/TOF instrument, the ion gate needs to be arranged close to the focal point of TOF1. In the present embodiment, the position of the ion gate can be set relatively at will. Therefore, where two ion gates are used, various methods of arrangement are available. However, elongation of the voltage supply line to the ion gates will deteriorate the response of the ion gates themselves. Taking account of this, the ion gates may be arranged in the space in the same hierarchical layer as shown in FIG. 14A. As shown in FIG. 14B, the ion gates may be arranged at relatively close positions in different hierarchical layers. In FIG. 14C, an ion gate of the Bradbury-Nielson type spans different hierarchical layers. The ion gate is one integral structure. Of course, parallel-plate ion gates may be similarly arranged.

Fifth Embodiment

The present embodiment provides a method of selecting plural precursor ions in measurement using the same laser irradiation to reduce consumption of a sample. The present embodiment is a modification of the first embodiment. The second through fourth embodiments may be modified similarly.

First, the compounds of a sample are ionized in the MALDI ion source. The resulting ions are accelerated by a pulsed voltage. The compounds of the sample are changed into ions of the sample by the ionization. In the first TOF-MS, the ions of the sample are separated according to mass-to-charge ratio. The ions of the sample passed through the first TOF-MS are selected by the ion gate. The selected precursor ions enter the collision cell and collide with the gas filled in the cell, thus inducing fragmentation. As a result, product ions are created. The precursor ions and product ions are detected by the detector.

Figure 15A:
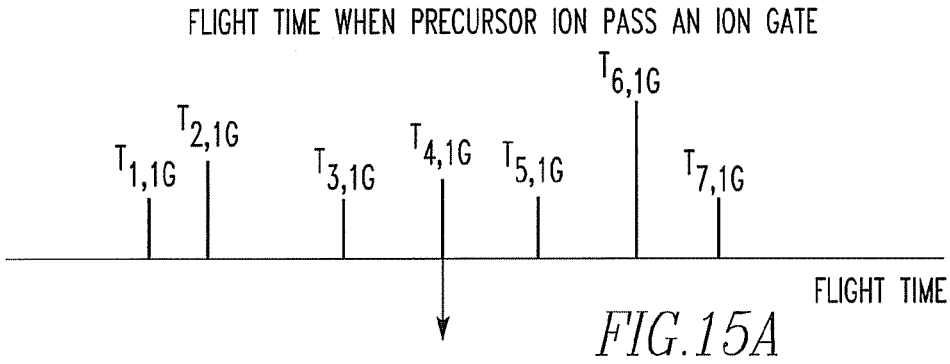
FIGS. 15A, 15B, and 15C are conceptual diagrams of MS/MS measurements in which plural precursor ions are selected.
Figure 15B:
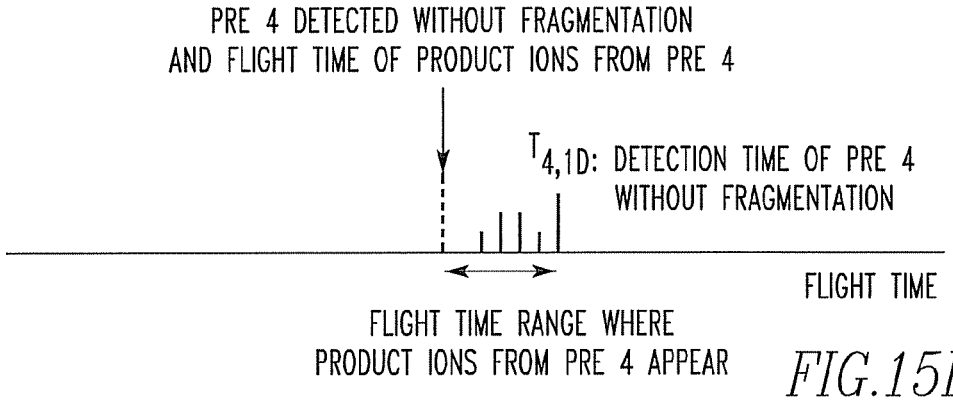
Figure 15C:
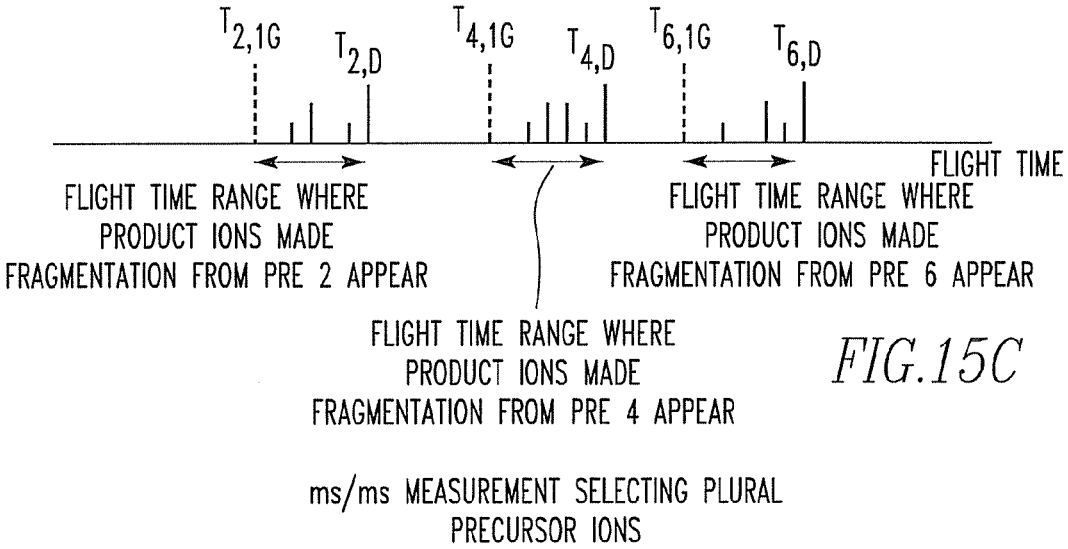

The MS/MS mode in which plural precursor ions are selected is next described by referring to FIGS. 15A, 15B and 15C. For the sake of illustration, it is assumed that there are seven sample-derived precursor ions Pre1 to Pre7 in the MALDI ion source. Each ion has a valence of 1. Ions bearing smaller numbers have smaller masses. The ions are accelerated by the MALDI ion source and mass-separated by the first TOF-MS. Then, as shown in FIG. 15A, the ions arrive at the ion gate in order from lightest to heaviest.

Let $T_{N,IG}$ be the arrival time of each precursor ion PreN at the ion gate. First, an MS/MS measurement in which one precursor ion Pre4 is selected is discussed. If only the Pre4 is selected by the ion gate and admitted into the collision cell, there are two cases: in one case, fragmentation is induced and product ions are created; in the other case, precursor ions are passed intact through the collision cell without producing fragmentation. Where fragmentation occurs, the kinetic energy $U_{pre4}$ possessed by the precursor ion is distributed in proportion to the masses of the product ions during fragmentation. That is, the kinetic energy $U_{pro}$ of the product ion becomes $m/M_{pre4} \times U_{pre4}$ (where m is the mass of the product ion).

Subsequently, the precursor ions and product ions are admitted into the second TOF-MS. In the reflectron field of the reflectron-type TOF-MS, ions having smaller kinetic energies turn back and arrive at the detector earlier. Therefore, the precursor ions arrive at the detector lastly. Let $T_{N,D}$ be the arrival time of each precursor ion PreN at the detector. That is, with respect to an MS/MS spectrum derived when Pre4 is selected, the interval from $T_{4,IG}$ to $T_{4,D}$ may be measured.

In this way, the range of flight times necessary for MS/MS measurement of precursor ions, respectively, can be easily calculated. It can be seen that if ranges of flight times do not interfere with each other, plural MS/MS measurements can be performed in the same flight time measurement.

To achieve these circumstances, the interval between flight times of precursor ions at the ion gate should be greater than the flight time range necessary for MS/MS measurement. For this purpose, it is necessary to increase the ratio of the effective flight distance L1 in the first TOF-MS to the effective flight distance L2 in the second TOF-MS (i.e., L1/L2). A spiral trajectory TOF-MS can achieve an effective flight distance about 10 times greater than the effective flight time of the prior art reflectron TOF-MS. Consequently, an MS/MS measurement is enabled in which plural precursor ions are selected in the same flight time measurement by combining a spiral trajectory TOF-MS and a reflectron TOF-MS.

This discussion is now conducted more quantitatively. Table 3 shows the results of calculations of the relationship between the mass of the first precursor ion and the mass of the precursor ion capable of being selected next with various values of L1/L2 and various values of the mass of the precursor ion selected first during MS/MS measurement in which plural precursor ions are selected.

TABLE 3

| mass of precursor ion selected first | mass of precursor ion that can be selected next L1/L2 = 10 | L1/L2 = 5 | L1/L2 = 0.5 |
|---|---|---|---|
| 500 | 605 | 720 | 4,500 |
| 600 | 726 | 864 | 5,400 |
| 700 | 847 | 1,008 | 6,300 |
| 800 | 968 | 1,152 | 7,200 |
| 900 | 1,089 | 1,296 | 8,100 |
| 1,000 | 1,210 | 1,440 | 9,000 |
| 1,100 | 1,331 | 1,584 | 9,900 |
| 1,200 | 1,452 | 1,728 | 10,800 |
| 1,300 | 1,573 | 1,872 | 11,700 |
| 1,400 | 1,694 | 2,016 | 12,600 |
| 1,500 | 1,815 | 2,160 | 13,500 |

In the present invention, the value of the effective flight distance L1 of the first TOF-MS can be set relatively at will by the distance of the circular trajectory of the spiral trajectory TOF-MS and the number of turns. Table 3 shows cases where L1/L2 values are 5 and 10, respectively. In the case of the prior art TOF/TOF instrument, L2 is longer in many cases, and L1/L2 values are approximately less than 0.5. It can be seen from Table 3 that in the case of the prior art instrument, the mass difference between the first selected precursor ion and the next selectable precursor ion is so great that selection of plural precursor ions is substantially impossible to perform. In contrast, in the case of the present instrument, the mass difference between the first selected precursor ion and the next selectable precursor ion is of the order of hundreds and so plural precursor ions can be selected sufficiently.

Sixth Embodiment

Figure 16A:
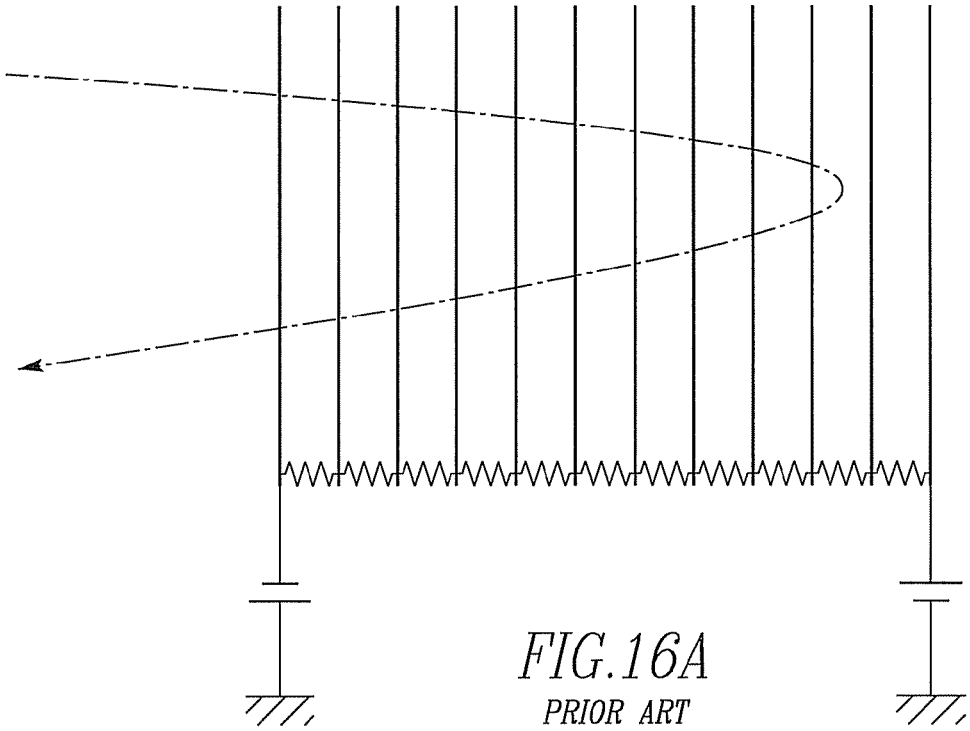
FIG.16A PRIOR ART
FIG. 16 is a diagram illustrating a reflectron field produced according to one embodiment, as well as a reflectron field produced by prior art.

Often, as shown in FIG. 16A, an ion mirror has an array of tens of perforated electrodes. A power supply is supplied across the electrode array. Voltages are supplied to the intermediate electrodes by division of resistance. In many cases, the voltages at the opposite ends of the ion mirror are opposite in polarity and are on the opposite sides of ground potential.

Figure 16B:
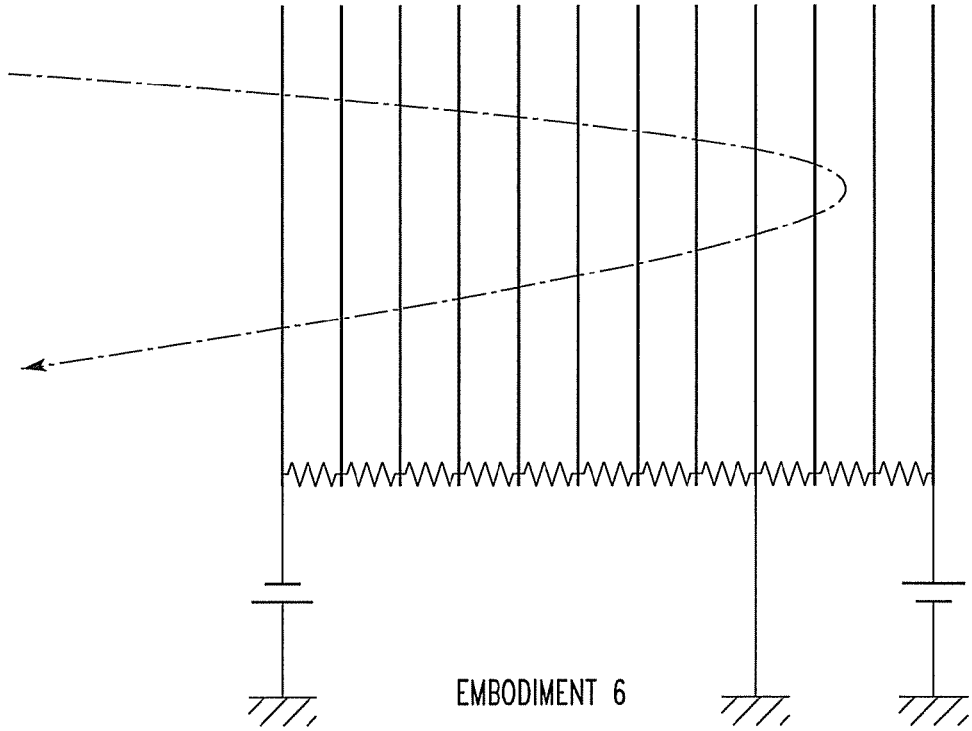

The power supplies suffer from voltage ripples or drift with time due to temperature variations. The voltages supplied to the electrodes contain ripples or drift with time as described previously. Variations in the power supplies connected with the opposite ends are summed up. In the present embodiment, as shown in FIG. 16B, in a case where the potentials are opposite in polarity and are on the opposite sides of ground potential, the effects of variations in the power supplies are suppressed by connecting one electrode with ground potential. The accuracy of the power supplies for the electrodes can be improved. That is, the accuracy of flight time during measurement can be improved.

The present invention can be widely applied to tandem MS measurements performed with time-of-flight mass spectrometers.

Having these described my invention with the detail and particularity required by the Patent Laws, what is desired protected by Letters Patent is set forth in the following claims.

The invention claimed is:

1. A tandem time-of-flight mass spectrometer comprising:

an ion source for ionizing a sample;

acceleration means for accelerating the created ions in a pulsed manner;

a first time-of-flight mass spectrometer (TOF-MS) of a spiral trajectory type composed of plural electric sectors, the first TOF-MS causing the accelerated ions to travel spirally;

an ion gate placed within the first TOF-MS and selecting only ions having certain mass-to-charge ratios;

a collision cell disposed downstream of the ion gate and filled with a gas to fragment the selected ions;

a second time-of-flight mass spectrometer (TOF-MS) of a reflectron type, the second TOF-MS being disposed downstream of the collision cell, the second TOF-MS analyzing masses of the fragmented ions; and a detector for detecting ions passed through the second TOF-MS, wherein the first TOF-MS satisfies spatial focusing conditions for a direction of flight and for a plane orthogonal to the direction of flight whenever the ions make a turn in the spiral trajectory; and wherein the ion gate is placed in the spiral trajectory of the first TOF-MS and the ions selected by said ion gate pass the electric sectors disposed downstream of the ion gate and enter said collision cell.

2. A tandem time-of-flight mass spectrometer as set forth in claim 1, wherein another detector capable of moving into and out of an ion flight trajectory is mounted between the first TOF-MS and the second TOF-MS.

3. A tandem time-of-flight mass spectrometer as set forth in claim 1, wherein there are further provided a detector for detecting ions passed through the first TOF-MS and holes permitting passage of ions in the electric sectors present between the detector and the ion gate, and wherein said collision cell and said second TOF-MS are so arranged that ions passed through the holes enter the collision cell.

4. A tandem time-of-flight mass spectrometer as set forth in claim 3, wherein supply of power to a hierarchical layer including the ion passage hole in the electric sector having the ion passage hole can be shut off independent of other hierarchical layers, and wherein in a case where a tandem mass analysis is made with said first and second TOF-MSs, supply of power to the hierarchical layer is shut off and ions are permitted to pass through the hole.

5. A tandem time-of-flight mass spectrometer as set forth in claim 4, wherein a time at which said power supply is shut off is timing of passage of precursor ions.

6. A tandem time-of-flight mass spectrometer as set forth in claim 1, wherein two ion gates are disposed in the same free space in said spiral trajectory, and wherein voltages for turning on and off the gates are supplied from the same power supply.

7. A tandem time-of-flight mass spectrometer as set forth in claim 1, wherein two ion gates are disposed in different free spaces but at the same angular position in the spiral trajectory, and wherein voltages for turning on and off the gates are supplied from the same power supply.

8. A tandem time-of-flight mass spectrometer as set forth in claim 1, wherein plural ion gates are disposed in different free spaces but at the same angular position in the spiral trajectory.

9. A tandem time-of-flight mass spectrometer as set forth in claim 8, wherein after ions have passed through all of the ion gates, the ions are passed through the electric sectors.

10. A tandem time-of-flight mass spectrometer as set forth in claim 1, wherein a deceleration region is disposed upstream of said collision cell, and wherein a reacceleration region is disposed downstream of the collision cell.

11. A tandem time-of-flight mass spectrometer as set forth in claim 1, wherein the reflectron field in said second TOF-MS is an ion mirror having a curved potential distribution.

12. A tandem time-of-flight mass spectrometer as set forth in claim 1, wherein a reacceleration region is disposed downstream of said collision cell, and wherein the reflectron field in said second TOF-MS is an ion mirror having a potential distribution having a shape that is a tandem combination of a straight line and a parabolic line.

13. A tandem time-of-flight mass spectrometer as set forth in claim 1, wherein (A) a reflectron field is produced by plural electrodes, (B) two power supplies having polarities on opposite sides of ground potential are connected with two electrodes on both ends, (C) a voltage-dividing resistor connects adjacent electrodes, and (D) in a case where voltages supplied to said plural electrodes are divisionally supplied from said two power supplies via said dividing resistor, one electrode interposed between the two electrodes on both sides is set to ground potential.

14. A tandem time-of-flight mass spectrometer as set forth in claim 1, wherein the sample is ionized in said ion source by illuminating the sample on a conductive sample plate with laser light.

15. A tandem time-of-flight mass spectrometer as set forth in claim 14, wherein the sample is ionized in said ion source by a MALDI process.

16. A tandem time-of-flight mass spectrometer as set forth in claim 15, wherein said means for accelerating the ions is delayed extraction.

17. A tandem time-of-flight mass spectrometer as set forth in claim 1, wherein said ion source is of a continuous type, and wherein the acceleration means for accelerating the ions out of the ion source in a pulsed manner is an orthogonal acceleration method consisting of conveying the ions created by the continuous ion source with low energies and accelerating the ions in a pulsed manner.

18. A method of tandem time-of-flight mass spectrometry, comprising the steps of:

performing one time-of-flight MS measurement using a tandem time-of-flight mass spectrometer as set forth in claim 1;

selecting plural precursor ions; and performing an MS/MS measurement.

19. A method of tandem time-of-flight mass spectrometry as set forth in claim 18, wherein said plural precursor ions are all monoisotopic ions.

* * * * *